US005290027A

United States Patent [19]

Clanton et al.

[11] Patent Number: 5,290,027

[45] Date of Patent: Mar. 1, 1994

[54] ARTICLE POSITIONING APPARATUS AND METHOD FOR POSITIONING AN ARTICLE

[75] Inventors: Joel D. Clanton, Shelbyville; Ray F. Beatty, III, Nashville, both of Tenn.

[73] Assignee: ARK, Inc., Shelbyville, Tenn.

[21] Appl. No.: 838,526

[22] Filed: Feb. 19, 1992

[51] Int. Cl.[5] ..... B65H 7/02

[52] U.S. Cl. ..... 271/227; 271/253; 112/121.15; 112/262.3

[58] Field of Search ..... 271/227, 236, 253, 254; 112/121.12, 308, 309, 121.15, 262.3

[56] References Cited

U.S. PATENT DOCUMENTS

| | | | |
|---|---|---|---|
| 4,353,539 | 10/1982 | Doyen et al. | 271/10 |
| 4,406,234 | 9/1983 | Johnson et al. | 112/121.12 |
| 4,410,171 | 10/1983 | Kobayashi | 271/227 |
| 4,438,912 | 3/1984 | Janssen et al. | 271/227 |
| 4,498,404 | 2/1985 | Sadeh | 112/121.12 |
| 4,628,843 | 12/1986 | Tajima | 112/121.12 |
| 4,693,460 | 9/1987 | Adamson et al. | 271/10 |
| 4,776,579 | 10/1988 | Romand et al. | 271/228 |
| 4,836,119 | 6/1989 | Siraco et al. | 112/308 X |
| 4,917,030 | 4/1990 | Bisson et al. | 112/121.12 |
| 4,971,304 | 11/1990 | Lofthus | 271/227 |
| 4,993,334 | 2/1991 | Henze et al. | 112/121.12 |
| 5,012,752 | 5/1991 | Murata et al. | 271/227 X |
| 5,018,462 | 5/1991 | Brocklehurst | 112/121.12 |
| 5,081,943 | 1/1992 | Nakanishi | 112/121.12 |
| 5,081,944 | 1/1992 | Nakanishi | 112/121.12 |
| 5,131,339 | 7/1992 | Goodridge | 271/227 X |
| 5,178,080 | 1/1993 | Nomura et al. | 271/227 X |

FOREIGN PATENT DOCUMENTS

| | | | |
|---|---|---|---|
| 289253 | 4/1991 | Fed. Rep. of Germany | 271/227 |
| 133148 | 7/1984 | Japan | 271/227 |
| 161657 | 7/1987 | Japan | 271/227 |

*Primary Examiner*—H. Grant Skaggs
*Assistant Examiner*—Boris Milef
*Attorney, Agent, or Firm*—Senniger, Powers, Leavitt & Roedel

[57] ABSTRACT

Article positioning apparatus having a positioning surface and sensors for sensing the location of an article on the positioning surface with reference to an X direction, with reference to a Y direction perpendicular thereto, and with reference to an angular orientation in the plane of the positioning surface about an axis generally perpendicular to the X direction and the Y direction. Motors are provided for moving the article in the X direction, in the Y direction, and for rotating the article generally about the axis. A controller responsive to the sensors selectively activates the X motor, Y motor and rotating motor to position the article.

15 Claims, 4 Drawing Sheets

ARTICLE POSITIONING APPARATUS AND METHOD FOR POSITIONING AN ARTICLE

BACKGROUND OF THE INVENTION

This invention relates generally to apparatus and method for positioning an article and more particularly to such apparatus and method for positioning an article in an predetermined X position, Y position and predetermined angular orientation.

Automated manufacturing processes frequently require that the article being processed be precisely positioned before a certain operation on the article is performed. For instance, if a seam on a piece of fabric is to be sewn, it is necessary that the fabric piece be properly aligned before being fed into a sewing machine. The need for precise alignment has necessitated in the apparel industry that aligning just prior to sewing be carried out be hand, significantly adding to the cost of the process. In the past, automatic or machine accomplished alignment of fabric in one direction has been used. However, proper alignment of an piece of fabric in a plane requires orientation in two linear directions and angular orientation. In some instances, it is desirable to center the fabric before further processing. Moreover, the alignment must be accomplished quickly so that a bottleneck in the manufacturing process is not created at the alignment station.

SUMMARY OF THE INVENTION

Among the several objects of the present invention may be noted the provision of article positioning apparatus and method for positioning an article which positions the article in an X direction, Y direction perpendicular to the X direction, and in an angular orientation; the provision of such apparatus and method which carries out alignment in the X direction, Y direction and angular orientation simultaneously; and the provision of such apparatus and method which centers the article.

Article positioning apparatus constructed according to the principles of the present invention includes a positioning surface and means for sensing the location of an article on the positioning surface with reference to an X direction, with reference to a Y direction perpendicular thereto, and with reference to an angular orientation in the plane of the positioning surface about an axis generally perpendicular to the X direction and the Y direction. Means are provided for moving the article in the X direction, the Y direction and for rotating the article generally about the axis. Control means is responsive to said sensing means for selectively activating said X moving means, said Y moving means, and said rotating means.

A method of positioning an article on a positioning surface according to the present invention includes the steps of sensing the location of the article on the positioning surface in reference to an X direction, in reference to a Y direction perpendicular to the X direction, and in reference to an angular orientation in the plane of the positioning surface about an axis generally perpendicular to the X direction and the Y direction. The article is moved in the X direction in response to X direction sensing, in the Y direction in response to Y direction sensing and rotated generally about the axis in response to angular sensing.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 3:
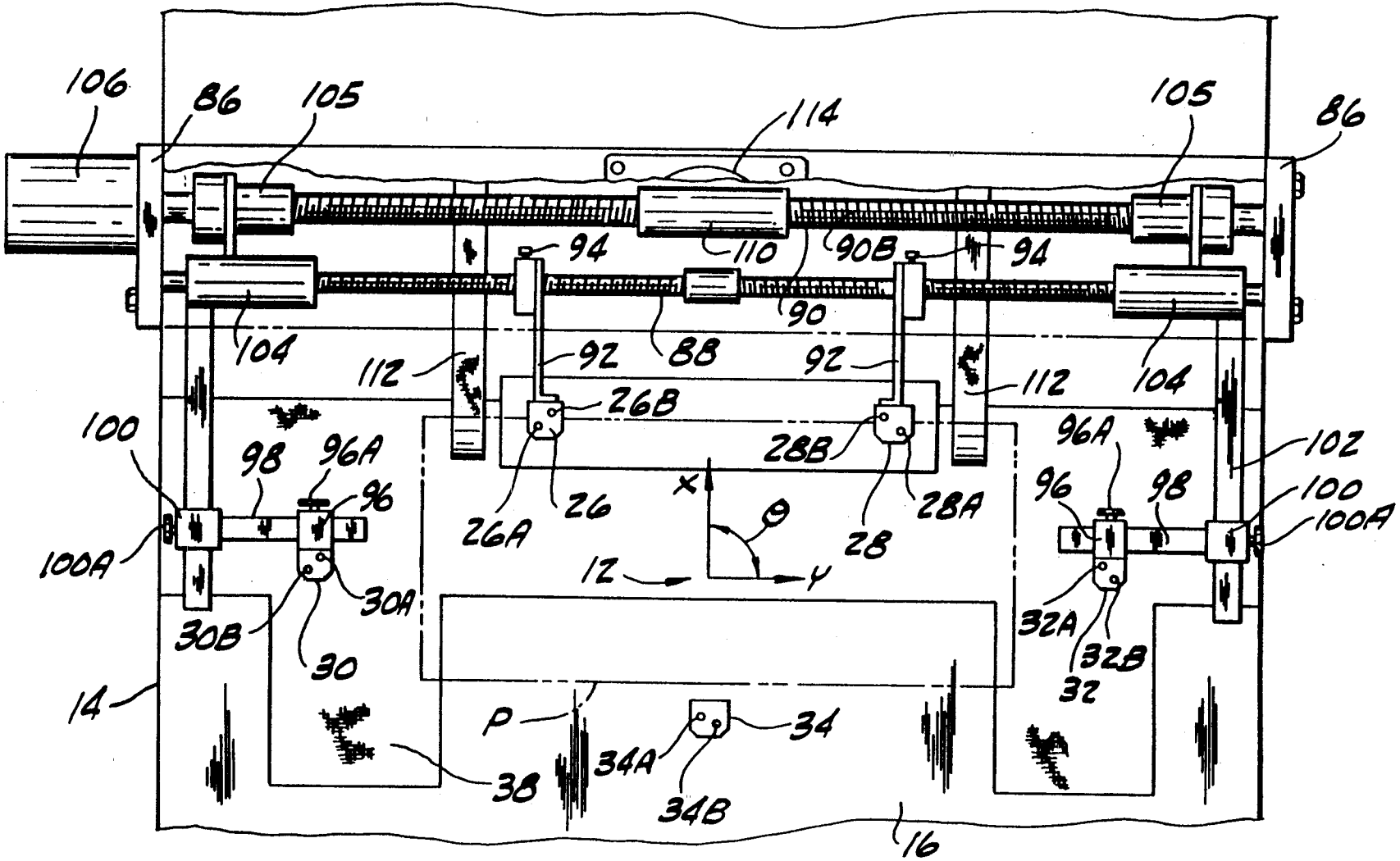
FIG. 3 is a fragmentary top plan showing a sensor array.
Figure 4:
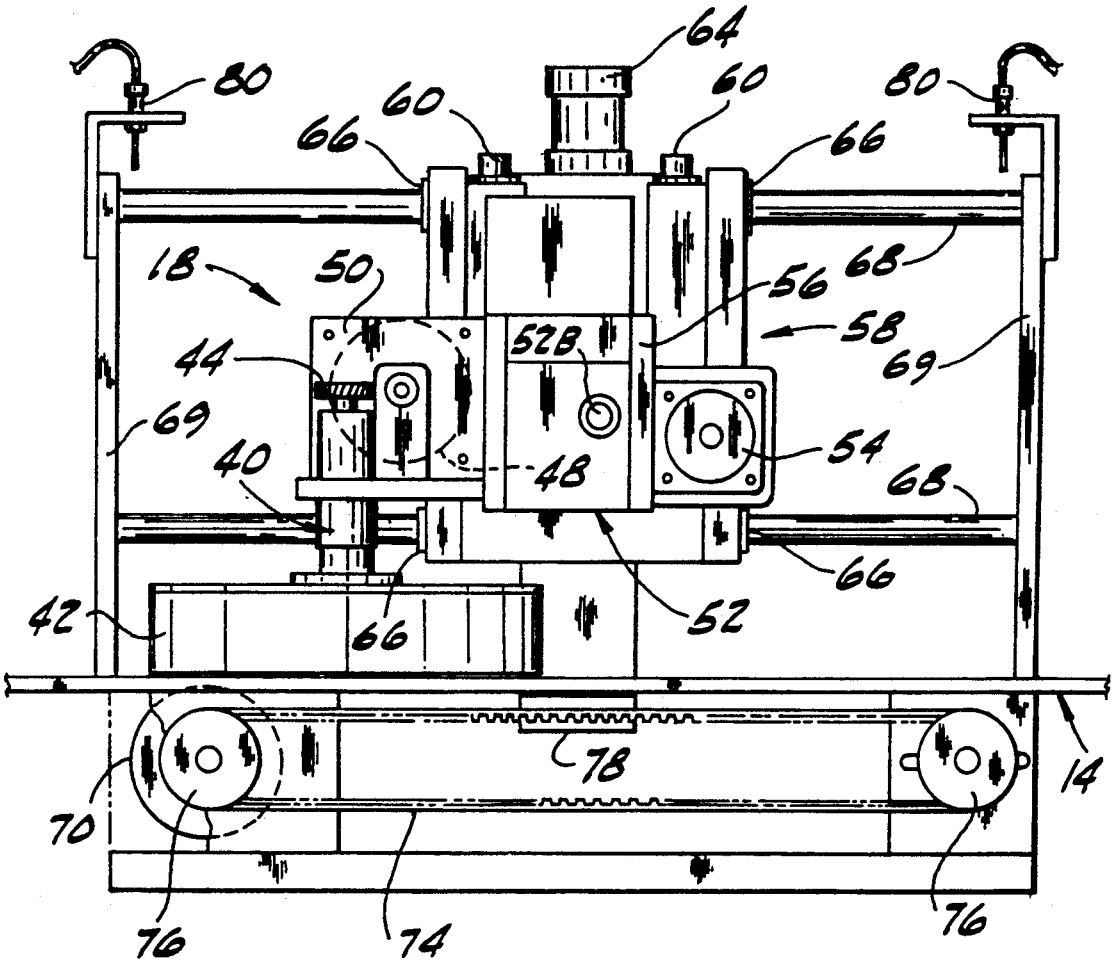
FIG. 4 is an elevation of the manipulator arm and supporting structure therefor.

Referring now to the drawings, an article positioning apparatus generally indicated at 10 for positioning an article such as a flat, limp work piece of fabric P is capable of orienting the fabric on the positioning surface with reference to an X direction, with reference to a Y direction and with reference to an angular or theta orientation 8 in the plane of the positioning surface about an axis generally perpendicular to the X direction and Y direction, as indicated by the coordinate system 12 in FIG. 3. The apparatus includes a table 14 having a positioning surface 16 thereon made of a relatively slick material, such as a sheet of anodized aluminum or stainless steel, on which fabric may freely slide, and a manipulator, indicated generally at 18, for sliding the fabric work piece P over the positioning surface. The manipulator 18 is controlled by a microprocessor (controller 20), such as Shark model XL programmable controller manufactured by Reliance Electric Company of Cleveland, Ohio.

The microprocessor 20 is responsive to signals generated by a sensor array on the positioning surface which includes two laterally spaced X-theta sensors (indicated 26 and 28, respectively), two laterally spaced Y sensors (indicated 30 and 32, respectively), and a rear X sensor 34. The sensors each include two photoelectric eyes which are offset one from the other. The photoelectric eyes of the X-theta sensor 26 are designated 26A and 26B, respectively, and the photoelectric eyes of the X-theta sensor 28 are designated 28A and 28B, respectively. The photoelectric eyes of the Y sensor 30 are designated 30A and 30B, respectively, and the photoelectric eyes of the Y sensor 32 are designated 32A and 32B, respectively. The rear X sensor has two photoelectric eyes, designated 34A and 34B, respectively. The photoelectric eyes are preferably Keyence Fiber Optic Photoelectric Sensors, model FS2-60 manufactured by Keyence Corporation of Osaka, Japan and distributed by Keyence Corporation of America, Fairlawn, N.J. The photoelectric eyes operate by emitting light which is reflected by reflective tape 38 applied to the positioning surface 16 under the eyes. Referring to FIG. 3, the photoelectric eyes of the X-theta sensors 26, 28 and rear X sensor 34 are offset in the X direction, with the eyes 26A, 28A rearward of the eyes 26B, 28B. The photoelectric eyes 30A, 32A of the Y sensors are offset in the Y direction laterally inwardly of the eyes 30B, 32B. The function of the offset of the photoelectric eyes in the operation of the apparatus will be explained below.

Figure 2:
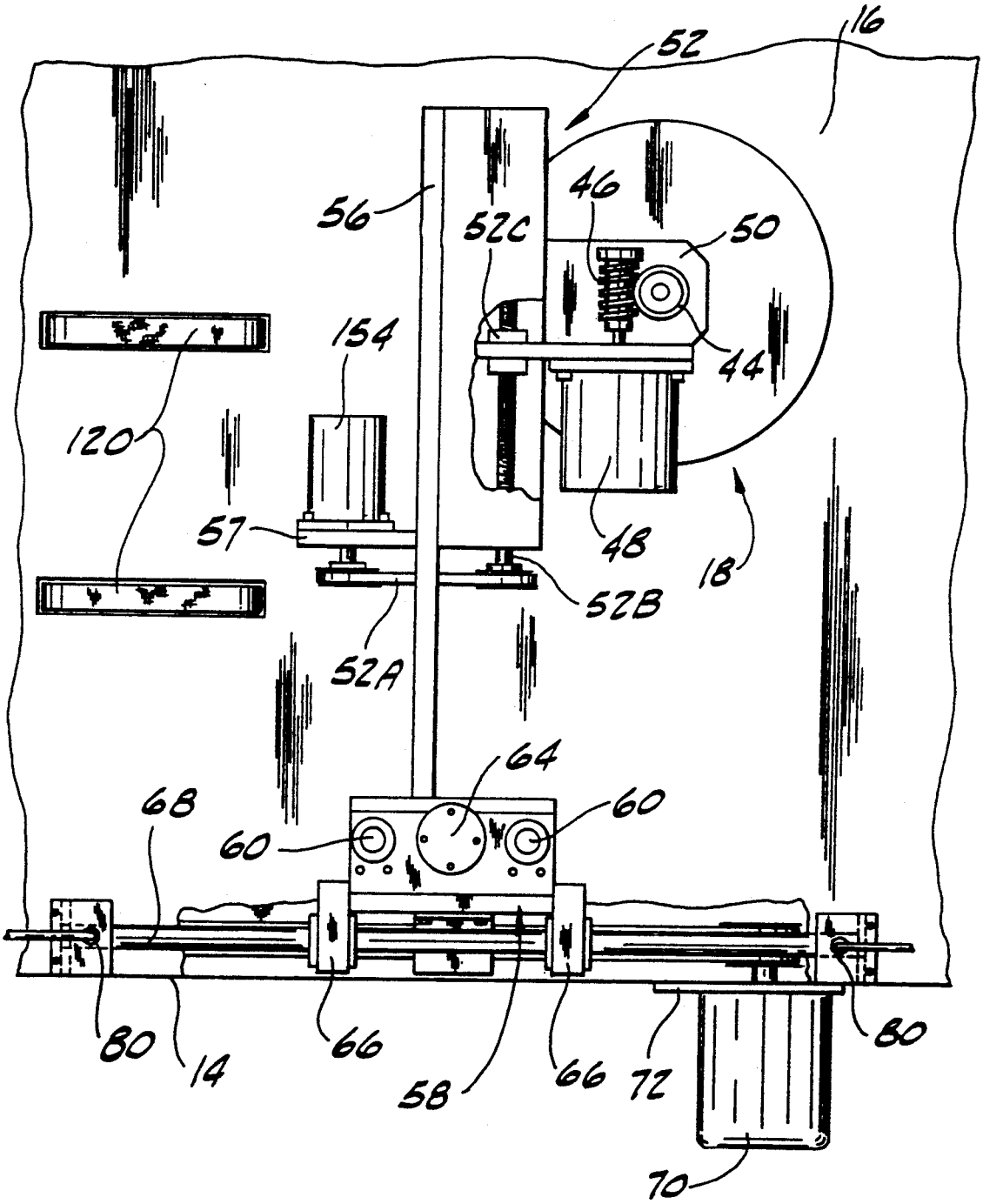
FIG. 2 is a fragmentary top plan showing a manipulator arm.

The manipulator 18 includes a positioning arm 40 having a pad 42 of high friction material, such as foam rubber, mounted on its lower end for engaging the fabric work piece P. The upper end of the arm 18 is formed as a gear 44 adapted to intermesh with a worm gear 46 driven by an electric theta motor 48 for rotating the positioning arm about its long axis in the theta direction. The manipulator 18 and theta motor 48 are supported on a bracket 50 (broadly, "first frame member") mounted on a ball screw mechanism, generally indicated at 52, driven by a Y motor 54 for selective motion in a Y direction along a second frame member 56 to which the ball screw mechanism is fixedly mounted. As shown in FIG. 2, the Y motor is mounted by a bracket 57 to the second frame member 56 and attached by a belt 52A to a screw 52B of the ball screw mechanism for rotating the screw and driving a ball nut 52C in the Y direction. The bracket 50 is connected to the ball nut 52C for motion therewith. The second frame member 56 is slidably mounted by a pair of rods 60 to a third frame member 58, which permits sliding motion between the second frame member and the third frame member in a vertical direction. An air cylinder 64 mounted on the third frame member 58 is attached to the second frame member 56 and connected to a source of air under pressure (not shown). Activation of the air cylinder 64 to raise and lower the second frame member 56, Y motor 54, ball screw mechanism 52 and manipulator 18 to move the pad 42 into and out of engagement with the fabric work piece P is controlled by the microprocessor 20.

The third frame member 58 includes slider blocks 66 for mounting the third frame member on a pair of vertically spaced rods 68 extending in the X direction along the side of the positioning surface 16 and mounted on the table 14 by support plates 69. An X motor 70 is mounted by a bracket 72 on the same side of the table 14 for driving a belt 74, riding on a pair of pulleys 76, to which the third frame member 58 is connected by a connecting portion 78. The X motor 70 is controlled by the microprocessor 20 for moving the third frame member 58 in the X direction. Limit sensors 80 are located at either end of the rods 68 to detect the third frame member 58 at the extreme forward or rearward X locations. Signals from these sensors 80 cause the microprocessor 20 to stop movement in the X direction, regardless of the indications from other sensors (26–32), thereby preventing an overrun.

In the embodiment of the invention disclosed herein, a mechanism is provided for centering the fabric work piece P in the Y direction. The mechanism, which includes the two movable Y sensors 30, 32 is used when the next operational step on the work piece requires, for instance, folding it in half and sewing together overlying portions of the folded fabric work piece. An example of a commercially available machine requiring a folded work piece is AMF model 84-35 semi-automatic pocket bag sewing machine manufactured and sold by AMF Apparel Machinery Company of Richmond, Va. However, it is to be understood that for many applications, centering of the fabric work piece is not necessary and a only a single, fixed Y sensor is required to locate an edge of the fabric work piece.

The X-theta sensors 26, 28 and Y sensors 30, 32 are mounted on a frame including laterally spaced stanchions 86 which are attached in a suitable manner, such as by bolting, to the table 24 The stanchions 86 support a rod 88 and a screw 90 which extend between the stanchions. The X-theta sensors 26, 28 are mounted by brackets 192 on the rod 88 in a fixed position. However, by loosening a set screw 94 on the brackets 92, the X-theta sensors 26, 28 can be adjusted in the Y direction as needed for the particular shape and size of the fabric work piece P to be positioned. The Y sensors 30, 32 are each mounted by a sleeve 96 on a laterally extending bar 98. The location of the Y sensors 30, 32 may be adjusted in the Y direction by loosening the set screws 96A and sliding the sleeve 96 along the bar 98. The bar 98 is attached by a similar sleeve 100 with a set screw 100A for adjustable positioning in the X direction on an arm 102. The arm 102 has a tubular bearing member 104 at its forward end slidingly supported on the rod 88 for motion lengthwise of the rod 88 in the Y direction. The bearing member 104 is attached to a ball nut 105 on the screw 90 which is selectively turned by an electric ball screw motor 106 controlled by the microprocessor 20. The screw 90 has two components 90A, 90B, connected together by a coupling 110, which are threaded in opposite directions so that rotation of the screw in a first direction moves the Y sensors 30, 32 toward one another, and rotation in the reverse direction results in the Y sensors moving away from one another.

A fabric feed mechanism also supported by the frame has a pair of feed belts 112 operable by an air cylinder 114 connected to the source of pressurized air (not shown) and operable, upon receiving a signal from the microprocessor 20 that the fabric work piece P has been properly aligned, to move the feed belts 112 into engagement with the fabric work piece. Thus, the fabric work piece, once aligned, is withdrawn from the positioning surface 16 to the workstation where the next operation can be performed on the work piece.

OPERATION

The fabric positioning apparatus of the present invention operates to simultaneously monitor and position the fabric work piece P in the X, Y and theta directions. The apparatus is controlled by the microprocessor 20 programmed with the commands listed in the attached Appendix. The commands for X-Y-theta orientation of the work piece begin at line 77 and continue through line 238. The remaining commands deal with other operations of the apparatus.

The operation begins with the delivery of a fabric work piece P onto the table 14 which continues delivering the fabric forward in the X direction to the positioning surface 16 by means of feed conveyors 120 in the table (FIG. 2). The work piece P initially blocks the rear X sensor 34, and in response the microprocessor 20 causes the feed conveyors 120 to drop below the positioning surface 16 so that forward movement of the work piece in the X direction is stopped. At the same time, the air cylinder 64 is activated by the microprocessor 20 to drop the second frame member 56 and bring the manipulator pad 42 into engagement with the fabric work piece.

After a one-half second delay, the X motor 70 is activated and the manipulator 18 is moved forward, sliding the fabric work piece with it over the slick positioning surface 16. The forward motion in the X direction continues until the fabric work piece blocks photoelectric eye 26A of the X-theta sensor 26 or photoelectric eye 28A of the other X-theta sensor 28. Upon receiving the appropriate signal from one of the eyes 26A, 28A of the X-theta sensors the microprocessor 20 deactivates the X motor 70 and forward motion in the X direction stops. Orientation of the fabric work piece in the theta direction commences according to the read-

BEST AVAILABLE COPY ings of the X-theta sensors 26, 28. The goal of theta orientation is to achieve an X-theta sensor reading wherein the eyes 26A, 28A are blocked by the work piece P, but eyes 26B, 28B are unblocked, as is shown in FIG. 3. If, however, the eye 26A is blocked, but the eye 28A is unblocked, the microprocessor 20 will activate the theta motor 48 to turn the manipulator pad 42 in a counterclockwise direction. The theta motor 42 is controlled to turn the fabric in a clockwise direction if, on the other hand, the eye 28A is blocked, but the eye 26A is unblocked.

At the same time the theta orientation is being achieved, the X location of the work piece is monitored. For instance, should the rotation of the work piece cause all of the eyes of the X-theta sensors 26, 28 to become unblocked, the microprocessor 20 will activate the X-motor 70 to move the work piece further forward in the X direction. Similarly, if all of the eyes of the X-theta sensors 26, 28 become blocked, the X motor 70 will be activated to move the work piece rearwardly. The monitoring of the X and theta positions is carried on concurrently, with the X motor 70 and theta motor 48 operated independently of each other by the microprocessor 20. Once both X and theta alignment is achieved, the movement of the manipulator 18 is stopped for one-half second before the X-theta sensors 26, 28 are reactivated, to allow the work piece to stop between movements and to give the microprocessor 20 time to get an accurate reading from the X-theta sensors.

Figure 1:
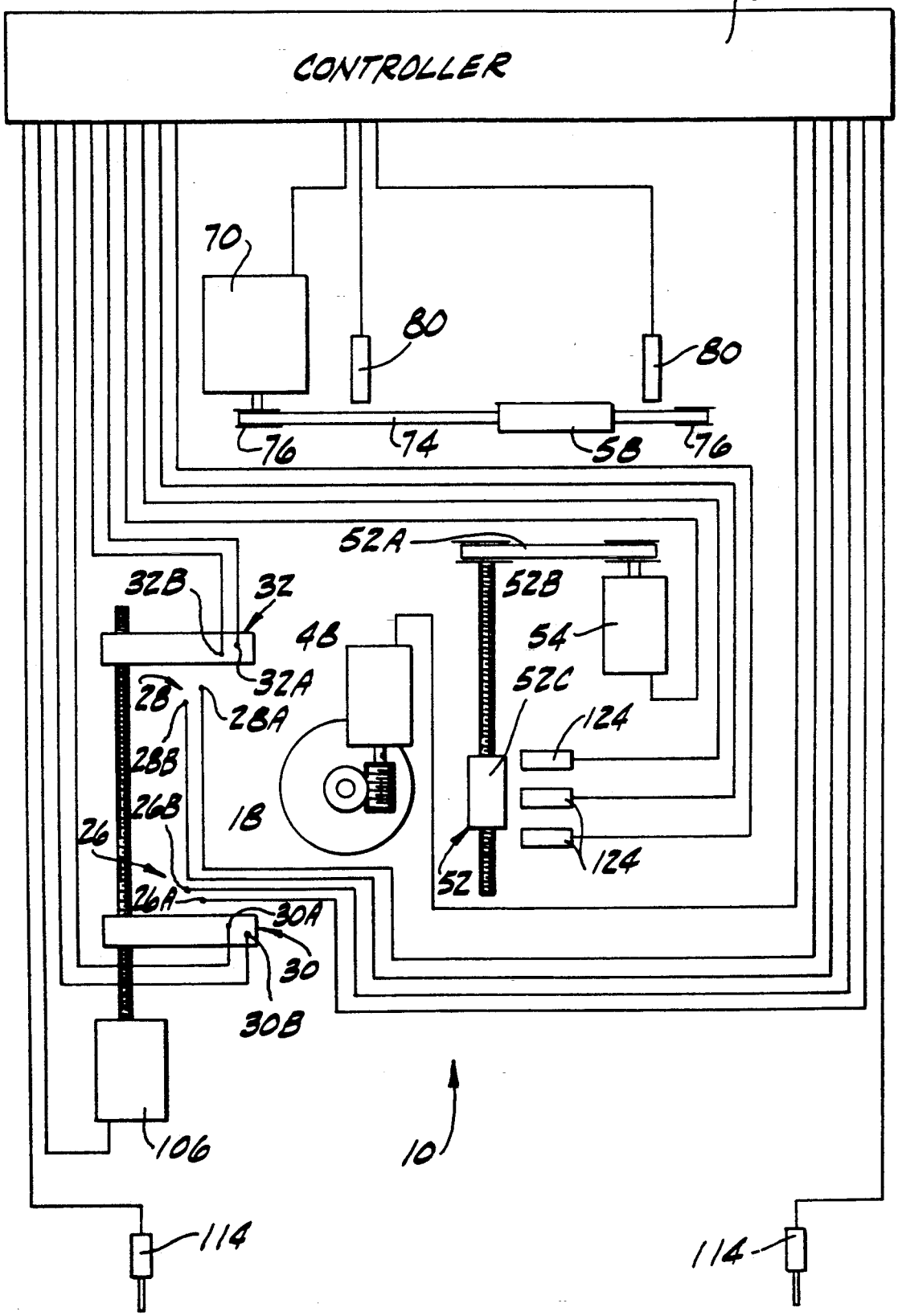
FIG. 1 is a schematic diagram of the apparatus.

After completion of the initial X and theta alignment, orientation of the work piece P in the Y direction is begun. In this embodiment, Y orientation involves centering the work piece between the laterally spaced Y sensors 30, 32. At the beginning, the Y sensors 30, 32 are located at positions laterally outwardly from the lateral edges of the work piece an equal distance from a line about which the work piece is to be centered. Satisfaction of the X and theta orientation requirements causes, after the described delay, the activation of the ball screw motor 106 for turning the screw 90 in a direction which brings the Y sensors 30, 32 toward one another. Eventually, the laterally inner eye of one of the Y sensors, for instance eye 30A, will be blocked by the fabric work piece. In response to such a signal, the microprocessor 20 activates the Y motor 54 to move the work piece in a Y direction away from the Y sensor 30 which has detected the work piece. The Y motor 54 moves the work piece faster than the movement of the Y sensors 30, 32 toward one another. Movement away from the sensor 30 continues until the lateral edge of the fabric work piece is detected by the laterally inner eye 32A of the other Y sensor 32. If the inner eye 30A of the Y sensor 30 is unblocked, the Y motor 54 is activated to move the work piece back in the Y direction toward the sensor 30. Back and forth motion in the Y direction occurs until both of the laterally inner eyes 30A, 32A of the Y sensors are blocked and the laterally outer eyes 30B, 32B are unblocked. Motion away from a particular Y sensor is also triggered when the laterally outer eye (30B or 32B) of that sensor is blocked. As shown in FIG. 1, Y limit sensors 124 are provided which are disposed to detect the Y motion of the manipulator 18 to prevent an overrun in the Y direction.

At the same time Y orientation is occurring, the X-theta sensors 26, 28 continue to monitor the leading edge of the fabric work piece. Should the Y motion cause, for instance, eye 28A to become unblocked while eye 26A remains blocked, the theta motor 48 will be activated at the same time Y orientation is being carried out to rotate the work piece counterclockwise. Similarly, if a situation occurs where both eyes 26A, 28A are unblocked or both of the forwardmost eyes 26B, 28B are blocked, the X motor 70 will be activated to move the work piece in an appropriate X direction (forward in the first situation, and rearward in the second). Thus, it may be seen that X, theta and Y orientation are simultaneously carried out by the apparatus of the present invention.

As previously mentioned, it is frequently not necessary to center the fabric work piece. In that event, only one Y sensor, located for detecting one lateral edge of the work piece, is necessary. The operation of the apparatus is substantially as before, but the Y sensor remains stationary and the work piece is brought to the Y sensor by the manipulator. Again, monitoring and repositioning in the X and theta positions occurs simultaneously with the Y orientation. When all of the sensors read one eye blocked (i.e., eyes 26A, 28A, 30A and 32A) and the other eye unblocked (i.e., eyes 26B, 28B, 30B and 32B) the microprocessor 20 determines that orientation is complete. Operation of the air cylinder 114 brings the feed belts 112 into engagement with the work piece and the feed belts are activated to draw the work piece off of the positioning surface 16 and into the workstation, and the manipulator 18 is moved back to its start position rearwardly of the sensor array for positioning the next work piece.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

APPENDIX

```
     !-    -                          +----------! 0000 ORG          990    -
9-   !                                !FUN98     ! ! 0001 AND          990    -
2    !-! !---! !-----------------------!STA      ! ! 0002 FUN98 STA
     ! 990   990                      !          ! !
     !                                +----------+ !
     !                                             !
     !SWITC SWITC SWITC PROX  LIGHT LIGHT    INTER ! 0003 ORG          034    SWITCH    CYCLE START
3-   !H     H-    H-                         NAL   ! 0004 OR           400    INTERNAL  AUTO CYCLE
10   !-! !---! !---! !---!/!---!/!---!/!---------( !- ! 0005 AND          035    SWITCH-   CYCLE STOP
     ! 034 ! 035   043   032   301   303        400 ! 0006 AND          043    SWITCH-   AUTO
```

BEST AVAILABLE COPY

```
     !                                        ! 0007 AND  NOT        002    PROX      ( EXTENDED
     !INTER!                                  ! 0008 AND  NOT        301    LIGHT     NO PART AT FEEDER
     !NAL  !                                  ! 0009 AND  NOT        303    LIGHT     TABLE NOT IN
     !-! !-+                                  ! 0010 OUT             400    INTERNAL  AUTO CYCLE
     ! 400                                    !
     !                                        !
     !                                        !
     !SWITC      PROX                    SOL  ! 0011 ORG             043    SWITCH-   AUTO
11-  !H-                                      ! 0012 STR NOT         043    SWITCH-   AUTO
15   !-! !-------+-! !-------------------( )- ! 0013 AND             040    SWITCH    MANUAL FEED
     ! 043      ! 013                     286 ! 0014 OR STR
     !          !                             ! 0015 AND             013    PROX      TABLE IN
     !SWITC SWITC!                            ! 0016 OUT             286    SOL       TABLE LOCK PIN
     !H-    H   !                             !
     !-!/!---! !-+                            !
     ! 043   040                              !
     !                                        !
     !                                        !
     !PROX- INTER                       INTER ! 0017 ORG             012    PROX-     TABLE UP
17-  !      NAL                           NAL ! 0018 OR              401    INTERNAL  TABLE IS IN THE UP POSITOIN
20   !-! !--+-! !-------------------------( )- ! 0019 AND             400    INTERNAL  AUTO CYCLE
     ! 012 ! 400                          401 ! 0020 OUT             401    INTERNAL  TABLE IS IN THE UP POSITOIN
     !     !                                  !
     !INTER!                                  !
     !NAL  !                                  !
     !-! !--                                  !
     ! 401                                    !
     !                                        !
     !                                        !
     !INTER INTER                       INTER ! 0021 ORG NOT         414    INTERNAL  PAD DOWN DURING ORIENT
21-  !NAL   NAL                           NAL ! 0022 OR  NOT         009    EYE       FIRST PIN FEEDER STOP EYE
26   !-!/!--+-! !-------+-------------------( )- ! 0023 STR             401    INTERNAL  TABLE IS IN THE UP POSITOIN
     ! 414 ! 401       !                  402 ! 0024 STR             040    SWITCH    MANUAL FEED
     !     !          !                      ! 0025 AND  NOT        043    SWITCH-   AUTO
     !EYE  !SWITC SWITC!                      ! 0026 OR STR
     !     !H     H-  !                      ! 0027 AND STR
     !-!/!--+-! !---!/!-+                     ! 0028 OUT             402    INTERNAL  PICK CYCLE CAN BEGIN
     ! 009   040   043                        !
     !                                        !
     !INTER TIMER -     TIMER -     LIGHT SOL  ! 0029 ORG             402    INTERNAL  PICK CYCLE CAN BEGIN
29-  !NAL                                     ! 0030 AND             T004   TIMER     TIME BEFORE PICKERS GO DOWN
35   !-! !---! !---!/!---!/!---!/!---!/!-------( )- ! 0031 AND  NOT        T026   -
     402   T004  T026  T002  512   302     282 ! 0032 AND  NOT        T002   TIMER     PICKER DOWN TIME
                                               ! 0033 AND  NOT        512    -
                                               ! 0034 AND  NOT        302    LIGHT     TABLE NOT IN
                                               ! 0035 OUT             282    SOL       PICKERS UP & DOWN
     !                                        !
     !SWITC                          +---------+ 0036 ORG NOT         014    SWITCH-   CONVEYOR (PICKERS UP)
36-  !--                             !TMR  T004 ! 0037 OUT             T004   0.0 TIMER TIME BEFORE PICKERS GO DOWN
37   !-!/-------------------------------!   0.0 ! !
     ! 014                           !TIMER    ! !
                                     +---------+ !
     !                                        !
     !SOL   TIMER LIGHT LIGHT            SOL  ! 0038 ORG             284    SOL       PICKERS PICK
38-  !                                         ! 0039 AND  NOT        T001   TIMER     PICK RELEASE TIME
46   !-! !---!/!--+-!/!---!/!-+-------------( )- ! 0040 STR             015    SWITCH-   PICKERS DOWN
     ! 284   T001! 301   302 !            284 ! 0041 AND  NOT        406    -         NOT USED
     !          !           !                  ! 0042 OR STR
     !SWITC -   !           !          +---------+ 0043 AND  NOT        301    LIGHT     NO PART AT FEEDER
     !H-        !           !          !TMR  T002 ! 0044 AND  NOT        303    LIGHT     TABLE NOT IN
     !-! !---!/!-+          ----------!   0.1   ! 0045 OUT             284    SOL       PICKERS PICK
     ! 015   406                       !TIMER    ! 0046 OUT             T002   0.1 TIMER PICKER DOWN TIME
     !                                 +---------+ !
     !                                        !
     !SWITC SOL   SWITC                   -   ! 0047 ORS NOT         010    SWITCH-   PICKERS UP
47-  !H-          H-                           ! 0048 AND             284    SOL       PICKERS PICK
```

```
53   !-|/|---| |--+-|/|-----------------------------( )- ! 0049 STR          405     -          NOT USED
     ! 010   284 ! 043                              405  ! 0050 AND  NOT     442     INTERNAL   X IS IN PROCESS OF ORIENT
                                                         ! 0051 OR STR
     !-     INTER!                                       ! 0052 AND  NOT     043     SWITCH-    AUTO
     !      NAL  !                                       ! 0053 OUT          405     -          NOT USED
     !-| |---|/|--+                                      !
     ! 405   442                                         !
     !                                                   !
     !                                                   !
     !SWITC SWITC INTER                  +---------+     ! 0054 ORG          053     SWITCH     PICKERS RELEASE
54-  !H     H-    NAL                    !TMR   T001 !   ! 0055 AND          010     SWITCH-    PICKERS UP
57   !-| |---| |---| |-------------------!    0.0  !   ! 0056 AND          415     INTERNAL   PICKER RELEASE
     ! 053   010   415                    !TIMER    !   ! 0057 OUT         T001  0.0 TIMER      PICK RELEASE TIME
     !                                   +---------+     !
     !                                                   !
     !INTER TIMER                              INTER    ! 0058 ORG          415     INTERNAL   PICKER RELEASE
58-  !NAL                                      NAL     ! 0059 AND  NOT     T001     TIMER      PICK RELEASE TIME
61   !-| |---|/ ---------------------------------( )-   ! 0060 OR           053     SWITCH     PICKERS RELEASE
     ! 415   T001!                              415     ! 0061 OUT          415     INTERNAL   PICKER RELEASE
     !          !                                        !
     !SWITC     !                                        !
     !H         !                                        !
     !-| |--------+                                      !
     ! 053                                               !
     !                                                   !
     !INTER INTER EYE                          INTER    ! 0062 ORG          457     INTERNAL   X & Y ARE HOME
62-  !NAL   NAL                                 NAL     ! 0063 AND          401     INTERNAL   TABLE IS IN THE UP POSITION
68   !-| |---| |---|/|-+-----------------------------( )- ! 0064 AND  NOT   022     EYE        SECOND PIN FEEDER STOP EYE
     ! 457   401   022 !                          412     ! 0065 STR          412     INTERNAL   ORIENT PAD DOWN
                                                         ! 0066 AND  NOT     450     INTERNAL   ORIENT FINISHED
     !INTER INTER     !                                  ! 0067 OR STR
     !NAL   NAL       !                                  ! 0068 OUT          412     INTERNAL   ORIENT PAD DOWN
     !-  ---| |--------+                                 !
     ! 412   457                                         !
     !                                                   !
     !                                                   !
     !EYE   SEW S INTER                        MOTOR    ! 0069 ORG          022     EYE        SECOND PIN FEEDER STOP EYE
69-  !      FEED  NAL                                   ! 0070 AND  NOT     T20     SEW SPEED  SEW SPEED 2
76   !-| |---| |---| |-----------------------------( )- ! 0071 OR  NOT     009     EYE        FIRST PIN FEEDER STOP EYE
     ! 022   T20 ! 401                            T00    ! 0072 AND          401     INTERNAL   TABLE IS IN THE UP POSITION
     !          !                                        ! 0073 STR NOT      043     SWITCH-    AUTO
     !EYE       !                                        ! 0074 AND          040     SWITCH     MANUAL FEED
     !          !                                        ! 0075 OR STR
     !-|/|--------                                       ! 0076 OUT          T00     MOTOR      PIN FEEDER RUN
     ! 009                                               !
     !                                                   !
     !SWITC SWITC                                        !
     !H-    H                                            !
     !-|/|---| |--------                                 !
     ! 043   040                                         !
     !                                                   !
     !                                                   !
     !INTER INTER                              INTER    ! 0077 ORG          414     INTERNAL   PAD DOWN DURING ORIENT
77-  !NAL   NAL                                 NAL     ! 0078 AND  NOT     450     INTERNAL   ORIENT FINISHED
81   !-| |---|/|-+-----------------------------( )-     ! 0079 OR           410     INTERNAL   ORIENT PAD DOWN
     ! 414   450 !                              414     ! 0080 OUT          414     INTERNAL   PAD DOWN DURING ORIENT
     !          !                                        ! 0081 OUT         T005  0.8 TIMER      X TRAVEL TIME
     !INTER     !                       +---------+     !
     !NAL       !                       !TMR   T005 !   !
     !-| |-------------------------------!    0.8  !   !
     ! 410                               !TIMER    !   !
     !                                   +---------+     !
     !                                                   !
     !INTER                                    SOL      ! 0082 ORG NOT      414     INTERNAL   PAD DOWN DURING ORIENT
81-  !NAL                                               ! 0083 OUT          289     SOL        ORIENT PAD UP / DOWN
83   !-|/|-----------------------------------------( )- !
     ! 414                                       289     !
```

BEST AVAILABLE COPY

```
     !                                          !
     !                                          !
     !TIMER INTER                       INTER ! 0084 ORG          T005    TIMER      X TRAVEL TIME
84-  !      NAL                           NAL  ! 0085 AND  NOT      412     INTERNAL
91   !-! !---!/!-------------+-----------( )- ! 0086 STR          411     INTERNAL   X MOVES IN TO ORIENT
     ! T005  412            !            411  ! 0087 AND          000     EYE-       FRONT RIGHT ON
     !                      !                 ! 0088 AND          003     EYE        FRONT LEFT OFF
     !INTER EYE-  EYE   PROX !                 ! 0089 AND  NOT     032     PROX       X EXTENDED
     !NAL                   !                 ! 0090 OR STR
     !-! !---! !---! !---!/!--                 ! 0091 OUT          411     INTERNAL   X MOVES IN TO ORIENT
     ! 411   000   003   032                   !
     !                                         !
     !INTER INTER                       INTER ! 0092 ORG          412     INTERNAL
92-  !NAL   NAL                          NAL  ! 0093 AND  NOT      450     INTERNAL   ORIENT FINISHED
95   !-! !--- !!-----------------------( )- ! 0094 OR           411     INTERNAL   X MOVES IN TO ORIENT
      412   450                         412   ! 0095 OUT          412     INTERNAL
     !                                         !
     !INTER                                    !
     !NAL                                      !
     !-! !--------                             !
     ! 412                                     !
     !                                         !
     !                                         !
     !INTER INTER                       INTER ! 0096 ORG          412     INTERNAL
96-  !NAL   NAL                          NAL  ! 0097 AND  NOT      411     INTERNAL   X MOVES IN TO ORIENT
101  !-! !---!/!-----------------------( )- ! 0098 STR          413     INTERNAL   THETA START
     ! 412   411 !                        413  ! 0099 AND  NOT      450     INTERNAL   ORIENT FINISHED
     !                                         ! 0100 OR STR
     !INTER INTER                              ! 0101 OUT          413     INTERNAL   THETA START
     !NAL   NAL  !                             !
     !-! !---!/!--                             !
     ! 413   450                               !
     !                                         !
     !                                         !
     !EYE-  EYE-  INTER INTER INTER      INTER ! 0102 ORG          000     EYE-       FRONT RIGHT ON
102- !            NAL   NAL   NAL        NAL  ! 0103 AND  NOT      002     EYE-       FRONT LEFT ON
113  !-! !---!/!--!/!---!/!---! !----------( )- ! 0104 STR          001     EYE -      FRONT RIGHT OFF
     ! 000   002 ! 421   442   413        420  ! 0105 AND  NOT      002     EYE-       FRONT LEFT ON
     !           !                             ! 0106 OR STR
     !EYE - EYE- !                             ! 0107 STR          000     EYE-       FRONT RIGHT ON
     !           !                             ! 0108 AND  NOT      003     EYE        FRONT LEFT OFF
     !-! !---!/!-!                             ! 0109 OR STR
     ! 001   002 !                             ! 0110 AND  NOT      421     INTERNAL   THETA ROTATE CW
     !           !                             ! 0111 AND  NOT      442     INTERNAL   X IS IN PROCESS OF ORIENT
     !EYE-  EYE  !                             ! 0112 AND          413     INTERNAL   THETA START
     !           !                             ! 0113 OUT          420     INTERNAL   THETA ROTATE CCW
     !-! !---!/!--                             !
     ! 000   003                               !
     !                                         !
     !                                         !
     !EYE   EYE - INTER INTER INTER      INTER ! 0114 ORG          003     EYE        FRONT LEFT OFF
114- !            NAL   NAL   NAL        NAL  ! 0115 AND  NOT      001     EYE -      FRONT RIGHT OFF
125  !-! !---!/!---!/!---!/!---! !----------( )- ! 0116 STR          002     EYE-       FRONT LEFT ON
     ! 003   001 ! 420   442   413        421  ! 0117 AND  NOT      001     EYE -      FRONT RIGHT OFF
     !           !                             ! 0118 OR STR
     !EYE-  EYE -!                             ! 0119 STR          003     EYE        FRONT LEFT OFF
     !           !                             ! 0120 AND  NOT      000     EYE-       FRONT RIGHT ON
     !-! !---!/!-!                             ! 0121 OR STR
     ! 002   001 !                             ! 0122 AND  NOT      420     INTERNAL   THETA ROTATE CCW
     !           !                             ! 0123 AND  NOT      442     INTERNAL   X IS IN PROCESS OF ORIENT
     !EYE   EYE- !                             ! 0124 AND          413     INTERNAL   THETA START
     !           !                             ! 0125 OUT          421     INTERNAL   THETA ROTATE CW
     !-! !---!/!--                             !
      003   000                                !
     !                                         !
```

```
     !INTER EYE - EYE-  EYE-  EYE                INTER ! 0126 ORG          412    INTERNAL  THETA START
124- !NAL                                        NAL  ! 0127 AND          001    EYE -     FRONT RIGHT OFF
134  !-! !---! !---! !---!/!---!/!---------------( )- ! 0128 AND          002    EYE-      FRONT LEFT ON
     ! 412   001   002   000   003 !              424  ! 0129 AND  NOT     000    EYE-      FRONT RIGHT ON
                                   !                   ! 0130 AND  NOT     002    EYE       FRONT LEFT OFF
     !INTER INTER                  !                   ! 0131 STR                 424    INTERNAL  THETA EDGE STRAIGHT
     !NAL   NAL                    !                   ! 0132 AND  NOT     450    INTERNAL  ORIENT FINISHED
     !-! !---!/!-------------------+                   ! 0133 OR STR
     ! 424   450                                        ! 0134 OUT          424    INTERNAL  THETA EDGE STRAIGHT
     !                                                  !
     !                                                  !
     !INTER TIMER                                MOTOR ! 0125 ORG          421    INTERNAL  THETA ROTATE CW
135- !NAL                                        ! 0126 AND          T012   TIMER     PULSE TIME THETA CW
137  !-! !---! !-------------------------------( )- ! 0127 OUT          264    MOTOR     ROTATE PAD CLOCKWISE
     ! 421   T012                                264  !
     !                                                  !
     !                                                  !
     !INTER TIMER                                MOTOR ! 0128 ORG          420    INTERNAL  THETA ROTATE CCW
138- !NAL                                        ! 0129 AND          T012   TIMER     PULSE TIME THETA CCW
140  !-! !---! !-------------------------------( )- ! 0130 OUT          265    MOTOR     ROTATE PAD COUNTER CLOCKWISE
     ! 420   T012                                265  !
     !                                                  !
     !                                                  !
     !INTER TIMER RELAY                          RELAY ! 0141 ORG          411    INTERNAL  X MOVES IN TO ORIENT
141- !NAL                                        ! 0142 OR           440    INTERNAL  X MOVE OUT
146  !-! !-+-! !---!/!-------------------------( )- ! 0143 AND          T011   TIMER     PULSE TIME X HOME
     ! 411 ! T011  261 !                          260  ! 0144 AND  NOT     261    RELAY     NOT USED
     !     !          !                               ! 0145 OUT          260    RELAY     NOT USED
     !INTER!          !                          INTER ! 0146 OUT          520    INTERNAL  X TO MOVE OUT
     !NAL  !          !                          NAL  !
     !-! !-+          +-------------------------( )- !
     ! 440                                       520  !
     !                                                  !
     !                                                  !
     !MOTOR                                      SOL  ! 0147 ORG          300    MOTOR     PIN FEEDER RUN
147- !                                           ! 0148 OUT          288    SOL       PIN FEEDER BELTS UP
148  !-! !-----------------------------------( )- !
     ! 300                                       288  !
     !                                                  !
     !                                                  !
     !INTER TIMER RELAY PROX-                    RELAY ! 0149 ORG          441    INTERNAL  X MOVE IN
149- !NAL                                        ! 0150 AND          T010   TIMER     PULSE TIME X IN
155  !-! !---! !-+-!/!---!/!-+-----------------( )- ! 0151 OR           460    INTERNAL  X GO TO HOME POSITION
     ! 441   T010! 260   033 !                    261  ! 0152 AND  NOT     260    RELAY     NOT USED
     !          !          !                          ! 0153 AND  NOT     033    PROX-     (X) HOME
     !INTER     !          !                    INTER ! 0154 OUT          261    RELAY     NOT USED
     !NAL       !          !                    NAL  ! 0155 OUT          521    INTERNAL  X TO MOVE HOME
     !-! !-------+          +-----------------( )- !
     ! 460                                       521  !
     !                                                  !
     !RELAY                                 ----------- ! 0156 ORG NOT      261    RELAY     NOT USED
156- !                                      !TMR   T010 ! 0157 OUT          T010   0.5 TIMER  PULSE TIME X IN
157  !-!/!-------------------------------!    0.5    ! !
     ! 260                                 !TIMER     ! !
     !                                   !-----------!
     !                                                  !
     !RELAY                                 ----------- ! 0158 ORG NOT      261    RELAY     NOT USED
158-                                       !TMR   T011 ! 0159 OUT          T011   0.5 TIMER  PULSE TIME X HOME
159  !-!/!-------------------------------!    0.5    ! !
     ! 261                                 !TIMER     ! !
     !                                   !-----------!
     !                                                  !
     !MOTOR                                 ----------- ! 0160 ORG NOT      265    MOTOR     ROTATE PAD COUNTER CLOCKWISE
160- !                                      !TMR   T012 ! 0161 OUT          T012   0.5 TIMER  PULSE TIME THETA CW
161  !-!/!-------------------------------!    0.5    ! !
     ! 265                                 !TIMER     ! !
     !                                   !-----------!
```

```
     !MOTOR                          +----------+ ! 0162 ORB NOT          264     MOTOR      ROTATE PAD CLOCKWISE
162- !                               !TMR   T012 ! 0163 OUT             T012  0.5 TIMER      PULSE TIME THETA CCW
163  !-!/!-------------------------!    0.5   ! !
     ! 264                          !TIMER    ! !
     !                              +----------! !
     !                                         !
     !EYE-  EYE   INTER INTER              INTER ! 0164 ORB             000     EYE-       FRONT RIGHT ON
164- !           NAL   NAL                  NAL  ! 0165 AND             003     EYE        FRONT LEFT OFF
169  !-! !---! !---! !---!/!----------------( )- ! 0166 AND             413     INTERNAL   THETA START
     ! 000   003   413   443                440  ! 0167 AND  NOT        443     INTERNAL   X MOVE IN
     !                                           ! 0168 OUT             440     INTERNAL   X MOVE OUT
     !
     !EYE - EYE-  EYE   EYE-  INTER        INTER ! 0169 ORB NOT         001     EYE -      FRONT RIGHT OFF
169- !                       NAL            NAL  ! 0170 AND  NOT        002     EYE-       FRONT LEFT ON
174  !-!/!---!/!---!/!---!/!---! !------------( )- ! 0171 AND  NOT        003     EYE        FRONT LEFT OFF
     ! 001   002   003   000   413          441  ! 0172 AND  NOT        000     EYE-       FRONT RIGHT ON
     !                                           ! 0173 AND             413     INTERNAL   THETA START
     !                                           ! 0174 OUT             441     INTERNAL   X MOVE IN
     !
     !INTER                               INTER ! 0175 ORB             441     INTERNAL   X MOVE IN
175- !NAL                                  NAL  ! 0176 OR              440     INTERNAL   X MOVE OUT
177  !-! !-----------------------------------( )- ! 0177 OUT             442     INTERNAL   X IS IN PROCESS OF ORIENT
     ! 441 !                                442  !
     !     !                                     !
     !INTER                                      !
     !NAL                                        !
     !-! !-+                                     !
     ! 440                                       !
     !                                           !
     !                                           !
     !EYE-  EYE - EYE-  EYE   INTER        INTER ! 0178 ORB NOT         000     EYE-       FRONT RIGHT ON
178- !                       NAL            NAL  ! 0179 AND  NOT        001     EYE -      FRONT RIGHT OFF
183  !-!/!---!/!---!/!---!/!---! !------------( )- ! 0180 AND  NOT        002     EYE-       FRONT LEFT ON
     ! 000   001   002   003   413          443  ! 0181 AND  NOT        003     EYE        FRONT LEFT OFF
     !                                           ! 0182 AND             413     INTERNAL   THETA START
     !                                           ! 0183 OUT             443     INTERNAL   X MOVE IN
     !
     !INTER EYE   EYE   PROX  INTER MOTOR  MOTOR ! 0184 ORB             424     INTERNAL   THETA EDGE STRAIGHT
184- !NAL                    NAL                ! 0185 AND  NOT        004     EYE        REAR RIGHT ON
191  !-! !---!/!---!/!---!/!---!/!---!/!---------( )- ! 0186 AND  NOT        006     EYE        REAR LEFT ON
     ! 424   004   006   029   425   269    269  ! 0187 AND  NOT        029     PROX       Y POSITION EYES EXTENDED
                                                  ! 0188 AND  NOT        425     INTERNAL   Y CENTERED
     !                                           ! 0189 AND  NOT        269     MOTOR      Y EYES OUT
     !                                           ! 0190 OUT             268     MOTOR      Y EYES IN
     !
     !INTER EYE   EYE   MOTOR INTER PROX-  MOTOR ! 0191 ORB             424     INTERNAL   THETA EDGE STRAIGHT
191- !NAL                    NAL            -   ! 0192 AND             004     EYE        REAR RIGHT ON
199  !-! !---! !---!/!---! /!--- / ---! !---------( )- ! 0193 AND  NOT        006     EYE        REAR LEFT ON
     ! 424   004   006   262   425 ! 031    262  ! 0194 AND  NOT        262     MOTOR      Y LEFT
     !                           !              ! 0195 AND  NOT        425     INTERNAL   Y CENTERED
     !INTER                      !              ! 0196 OR              472     INTERNAL   Y IS RIGHT
     !NAL                        !              ! 0197 AND             031     PROX-      (Y) CENTERED
     !-! !---------------------------            ! 0198 OUT             263     MOTOR -    Y RIGHT
     ! 472                                       !
     !                                           !
     !                                           !
     !INTER EYE   EYE   MOTOR INTER PROX-  MOTOR ! 0199 ORB             424     INTERNAL   THETA EDGE STRAIGHT
199- !NAL                -   NAL                ! 0200 AND             006     EYE        REAR LEFT ON
206  !-! !---! !---!/!---!/!---!/!--! !---------( )- ! 0201 AND  NOT        004     EYE        REAR RIGHT ON
     ! 424   006   004   263   425 ! 031    262  ! 0202 AND  NOT        263     MOTOR -    Y RIGHT
     !                           !              ! 0203 AND  NOT        425     INTERNAL   Y CENTERED
     !INTER                      !              ! 0204 OR              473     INTERNAL   Y IS LEFT
     !NAL                        !              ! 0205 AND             031     PROX-      (Y) CENTERED
     !-! !---------------------------+           ! 0206 OUT             262     MOTOR      Y LEFT
     ! 473                                       !
     !                                           !
```

BEST AVAILABLE COPY

```
     !                                          !
     !EYE   EYE   EYE-  EYE          INTER ! 0207 ORG          004     EYE       REAR RIGHT ON
207- !                                 NAL  ! 0208 AND          006     EYE       REAR LEFT ON
214  !-! !---! !---/!---!/!-------------( )- ! 0209 AND  NOT    005     EYE-      REAR RIGHT OFF
     ! 004   006   005   007 !          425  ! 0210 AND  NOT    007     EYE       REAR LEFT ON
     !                       !               ! 0211 STR          425     INTERNAL  Y CENTERED
     !INTER INTER            !               ! 0212 AND  NOT     450     INTERNAL  ORIENT FINISHED
     !NAL   NAL              !               ! 0213 OR STR
     !-! !---!/!-------------+               ! 0214 OUT          425     INTERNAL  Y CENTERED
     ! 425   450                             !
     !                                       !
     !                                       !
     !INTER INTER                   INTER ! 0215 ORG          425     INTERNAL  Y CENTERED
215- !NAL   NAL                       NAL  ! 0216 AND          424     INTERNAL  THETA EDGE STRAIGHT
217  !-! !---! !-----------------------( )- ! 0217 OUT          426     INTERNAL  FOLDER BELTS DOWN
     ! 425   424                      426  !
     !                                       !
     !INTER                         SOL   ! 0218 ORG          426     INTERNAL  FOLDER BELTS DOWN
218- !NAL                                  ! 0219 STR          290     SOL       FOLDER BELT UP   DOWN
227  !-! !-------------------------------( )- ! 0220 AND  NOT    291     SOL       FOLDER BLADE UP   DOWN
     ! 426                             290  ! 0221 OR STR
     !                                       ! 0222 OUT          290     SOL       FOLDER BELT UP - DOWN
     !SOL   SOL                   -----------  0223 OUT         T015    0.2 TIMER   TIME FOR ORIENT UP
     !                            TMR   T015
     !-  ----  ------------------------  0.2
     ! 291   291                  !TIMER    !
     !                            -----------
     !
     !TIMER                       -----------  0224 ORG         T015    TIMER     TIME FOR ORIENT UP
224-                              !TMR   T017  0225 OR          032     PROX      X EXTENDED
228  !-  ------------------------------!  0.2  ! 0226 OUT         T017    0.2 TIMER   TIME BEFORE FOLDER BELTS RUN
     ! T015                       !TIMER    ! 0227 AND  NOT    520     INTERNAL  X TO MOVE OUT
     !                            ----------- ! 0228 OUT         450     INTERNAL  ORIENT FINISHED
     !PROX  INTER                       INTER
     !      NAL                          NAL
     !-! !---  !-----------------------------( )- !
     ! 032   520                        450
     !
     !
     !INTER TIMER INTER                 INTER ! 0229 ORG         450     INTERNAL  ORIENT FINISHED
229- !NAL        NAL                     NAL  ! 0230 AND         T017    TIMER     TIME BEFORE FOLDER BELTS RUN
233  !-! !---! !--+-/!-------------------( )- ! 0231 OR          032     PROX      X EXTENDED
     ! 450   T017 452                   451  ! 0232 AND  NOT    452     INTERNAL  ONE SHOT ON # 451
     !          !                            ! 0233 OUT         451     INTERNAL  X & Y  GO TO HOME
     !PROX      !                            !
     !          !                            !
     !-!  --------                           !
     ! 032                                   !
     !                                       !
     !INTER INTER                       INTER ! 0234 ORG         451     INTERNAL  X & Y  GO TO HOME
234- !NAL   NAL                          NAL  ! 0235 STR         452     INTERNAL  ONE SHOT ON # 451
238  !-! !---!/!-----------------------( )- ! 0236 OR STR
     ! 451   452                        452  ! 0237 AND  NOT    453     INTERNAL  Y & X ARE HOME
     !                                       ! 0238 OUT         452     INTERNAL  ONE SHOT ON # 451
     !INTER-                                 !
     !NAL                                    !
     !-! !---                                !
     ! 452                                   !
     !                                       !
     !                                       !
     !MOTOR EYE-                        MOTOR ! 0239 ORG         295     MOTOR     FOLDER FEED BELTS RUN
239-                                         ! 0240 AND  NOT    008     EYE-      FOLDER FEED STOP
244  !-! !---!/!-----------------------( )- ! 0241 STR         451     INTERNAL  X & Y  GO TO HOME
     ! 295   008 !                       295  ! 0242 AND  NOT    032     PROX      X EXTENDED
     !           !                            ! 0243 OR STR
```

```
 INTER PROX                                  0244 OUT          295    MOTOR     FOLDER FEED BELTS RUN
 NAL
 451   022

 SOL   PROX  MOTOR                   SOL     0245 ORG          291    SOL       FOLDER BLADE UP   DOWN
245-                                         0246 AND  NOT     025    PROX      FOLDER BLADE DOWN
251                                          0247 STR          008    EYE-      FOLDER FEED STOP
 291   025   071                      291     0248 AND          522    -
                                             0249 OR STR
 EYE-  -                                     0250 AND  NOT     071    MOTOR     GUIDER MOTOR
                                             0251 OUT          291    SOL       FOLDER BLADE UP   DOWN
 008   522

 PROX-  PROX-                        INTER   0252 ORG          022    PROX-     (X) HOME
252-                                 NAL     0253 AND          031    PROX-     (Y) CENTERED
254                                          0254 OUT          453    INTERNAL  X & Y ARE HOME
 022   031                            453

 INTER PROX-                         INTER   0255 ORG          460    INTERNAL  X GO TO HOME POSITION
255-  NAL                            NAL     0256 AND  NOT     033    PROX-     (X) HOME
258                                          0257 OR           451    INTERNAL  X & Y  GO TO HOME
 460   033                            460     0258 OUT          460    INTERNAL  X GO TO HOME POSITION
 INTER
 NAL
 451

 INTER PROX                          INTER   0259 ORG          461    INTERNAL  Y POSITION EYES TO GO HOME
259-  NAL                            NAL     0260 AND  NOT     027    PROX      Y POSITION EYES HOME
262                                          0261 OR           451    INTERNAL  X & Y  GO TO HOME
 461   027                            461     0262 OUT          461    INTERNAL  Y POSITION EYES TO GO HOME
 INTER
 NAL
 451

 INTER PROX                          -       0263 ORG          451    INTERNAL  X & Y  GO TO HOME
263-  NAL                                    0264 OR           472    INTERNAL  Y IS RIGHT
266                                          0265 AND          030    PROX      Y FULL RIGHT
 451   030                            504     0266 OUT          504    -
 INTER
 NAL
 472

 INTER PROX                          INTER   0267 ORG          451    INTERNAL  X & Y  GO TO HOME
267-  NAL                            NAL     0268 OR           472    INTERNAL  Y IS RIGHT
270                                          0269 AND          030    PROX      Y FULL RIGHT
 451   030                            472     0270 OUT          472    INTERNAL  Y IS RIGHT
 INTER
 NAL
 472

 INTER PROX-                         INTER   0271 ORG          451    INTERNAL  X & Y  GO TO HOME
271-  NAL                            NAL     0272 OR           473    INTERNAL  Y IS LEFT
```

```
274  !-! !---!/!-----------------------------------( )-  ! 0273 AND          029    PROX-     Y FULL LEFT
     ! 451 ! 029                                   473   ! 0274 OUT          473    INTERNAL  Y IS LEFT
     !INTER!
     !NAL  !
     !-! !--
     ! 473
     !
     !INTER TIMER                                INTER ! 0275 ORG          501    INTERNAL  SEW BELT RUN
275- !NAL                                        NAL   ! 0276 AND  NOT     T020   TIMER     TIME BEFORE SEW FOOT DROP
279  !-! !---!/!-----------------------------------( )-  ! 0277 STR          026    PROX      FOLDER BLADE DOWN
     ! 501   T020!                                501   ! 0278 OR STR
     !          !                                        ! 0279 OUT          501    INTERNAL  SEW BELT RUN
     !PROX      !
     !          !
     !-! !--------
     ! 026
     !
     !
     INTER            MOTOR                      MOTOR ! 0280 ORG          461    INTERNAL  Y POSITION EYES TO GO HOME
280- !NAL                                               ! 0281 STR          424    INTERNAL  THETA EDGE STRAIGHT
286  !-! !-----------------!/!-----------------------( )-  ! 0282 AND          007    EYE       REAR LEFT ON
     ! 461              ! 268                     269   ! 0283 AND          005    EYE-      REAR RIGHT OFF
     !                                                   ! 0284 OR STR
     !INTER EYE   EYE- !                                 ! 0285 AND  NOT     268    MOTOR     Y EYES IN
     !NAL             !                                  ! 0286 OUT          269    MOTOR     Y EYES OUT
     !-! !---! !---! !-+
     ! 424   007   005
     !
     !
     !SWITC INTER PROX-                          MOTOR ! 0287 ORS          043    SWITCH-   AUTO
287- !H-    NAL                                         ! 0288 AND          400    INTERNAL  AUTO CYCLE
293  !-! !---! !--!/!-----------------------------( )-  ! 0289 STR NOT     043    SWITCH-   AUTO
     ! 043   400 ! 012                             266   ! 0290 AND  NOT     041    SWITCH-   MANUAL TABLE DOWN
     !          !                                        ! 0291 OR STR
     !SWITC SWITC!                                       ! 0292 AND  NOT     012    PROX-     TABLE UP
     !H-    H-  !                                        ! 0293 OUT          266    MOTOR     TABLE UP
     !-/!---!/!-+
     ! 043   041
     !
     !
     !SWITC SWITC PROX-                          MOTOR ! 0294 ORS NOT      043    SWITCH-   AUTO
3-   !H-    H-                                          ! 0295 AND          041    SWITCH-   MANUAL TABLE DOWN
-    !-  ---! ---! !-----------------------------( )-  ! 0296 AND  NOT     012    PROX-     TABLE DOWN
     ! 043   041   012                             267   ! 0297 OUT          267    MOTOR -   TABLE DOWN
     !
     !
     !EYE   INTER                          +----------+  0298 ORS          049    EYE       START SEW EYE
299-        NAL                            TMR   T020   0299 AND          500    INTERNAL  SEW CYCLE BEGIN
311  !-! !---  !-------------------------     0.1  !    0300 OUT          T020   0.1 TIMER  TIME BEFORE SEW FOOT DROP
     ! 049   500                           !TIMER  ! !  0301 OUT          T025   0.0 -
     !          !                          +----------+
     !          !                          +----------+
     !          !                          !TMR   T025 !
     !          +-------------------------!    0.0  ! !
     !                                     !-         ! !
     !                                     +----------+
     !-                                        SOL   ! 0302 ORS          510    -
302- !                                              ! 0303 STR          510    -
306  !-! !-----------------------------------------( )-  ! 0304 AND  NOT     052    COUNTER   PRESET TWO
     ! 510       !                                283   ! 0305 OR STR
     !          !                                        ! 0306 OUT          283    SOL       SLIDER DOWN
     !-     COUNT!
     !      ER  !
     !-! !---!/!-+
```

```
    ! 510   052                                  !
    !                                            !
    !                                            !
    !-                                   SOL.    ! 0307 ORG NOT          511      -
307-!                                    -       ! 0308 OUT              273      SOL. -     SEW FOOT
308 !-!/!-----------------------------------( )- !
    ! 511                                 273    !
    !                                            !
    !                                            !
    !-                              +---------+  ! 0309 ORG              511      -
309-!                               !TMR   T021  ! 0310 OUT             T021  0.1 TIMER     TIME BEFORE SEW BELTS RAISE
310 !-! !-------------------------------!   0.1  ! !
    ! 511                           !TIMER    ! !
    !                               +---------+ !
    !                                            !
    !INTER TIMER                         INTER   ! 0311 ORG              478      INTERNAL   SEW BELTS UP
311-!NAL                                 NAL     ! 0312 AND  NOT         T021     TIMER      TIME BEFORE SEW BELTS RAISE
314 !-! !---!/!-+-------------------------------( )- ! 0313 OR               501      INTERNAL   SEW BELT RUN
    ! 478   T021                          478    ! 0314 OUT              478      INTERNAL   SEW BELTS UP
    !          !                                 !
    !INTER     !                                 !
    !NAL       !                                 !
    !-! !-------+                                !
    ! 501                                        !
    !                                            !
    !INTER -                             SOL     ! 0315 ORG NOT          479      INTERNAL   SEW BELTS UP
    !NAL                                         ! 0316 AND  NOT         T021     -
    !-  ---  -------------------------------( )- ! 0317 OUT              292      SOL        SEW BELT UP - DOWN
    ! 479   T021                          292    !
    !                                            !
    !                                            !
    !TIMER INTER                         INTER   ! 0318 ORG              T021     TIMER      TIME BEFORE SEW BELTS RAISE
318-!      NAL                           NAL     ! 0319 AND  NOT         471      INTERNAL   SEW CYCLE TWO START
319 !-! --- !!-------------------------------- -!- ! 0320 OUT              470      INTERNAL   SEW CYCLE ONE START
    ! T021  471                           470    !
    !                                            !
    !                                            !
    !INTER COUNT                         INTER   ! 0321 ORG              471      INTERNAL   SEW CYCLE TWO START
321-!NAL   ER                            NAL     ! 0322 AND  NOT         052      COUNTER    PRESET TWO
324 !-  !---! !-------------------------------( )- ! 0323 OR               470      INTERNAL   SEW CYCLE ONE START
     471   052 !                          471    ! 0324 OUT              471      INTERNAL   SEW CYCLE TWO START
    !          !                                 !
    !INTER     !                                 !
    !NAL       !                                 !
    !-! !--------                                !
    ! 470                                        !
    !                                            !
    !                                            !
    !SEW S COUNT                         SEW S   ! 0325 ORG              321      SEW SPEED  SEW SPEED C
325-!PEED  ER                            PEED    ! 0326 OR               470      INTERNAL   SEW CYCLE ONE START
328 !-! !-+-!/!-------------------------------( )- ! 0327 AND  NOT         051      COUNTER    PRESET ONE
    ! 321 ! 051                           321    ! 0328 OUT              321      SEW SPEED  SEW SPEED C
    !     !                                      !
    !INTER!                                      !
    !NAL  !                                      !
    !-! !-+                                      !
    ! 470                                        !
    !                                            !
    !                                            !
    !SOL.  COUNT                         SOL.    ! 0329 ORG              272      SOL.       THREAD TRIMER
329-!      ER                                     ! 0330 AND  NOT         052      COUNTER    PRESET TWO
332 !-! !---!/!-+-------------------------------( )- ! 0331 OR               470      INTERNAL   SEW CYCLE ONE START
    ! 272   052 !                          272    ! 0332 OUT              272      SOL.       THREAD TRIMER
    !          !                                 !
    !INTER     !                                 !
    !NAL       !                                 !
    !-! !-------+                                !
```

BEST AVAILABLE COPY

```
     ! 470
     !
     !
     !COUNT SEW S INTER                    INTER ! 0333 ORG          051     COUNTER    PRESET ONE
333- !ER    PEED  NAL                      NAL   ! 0334 AND  NOT     321     SEW SPEED  SEW SPEED C
336  !-! !---!/!---!/!-------------------------( )- ! 0335 AND  NOT     475     INTERNAL   SEW CYCLE
     ! 051   321   475                       474  ! 0336 OUT          474     INTERNAL   SEW CYCLE ONE FINISHED
     !
     !INTER COUNT                           INTER ! 0337 ORG          475     INTERNAL   SEW CYCLE
337- !NAL   ER                              NAL   ! 0338 AND  NOT     052     COUNTER    PRESET TWO
340  !-! !---!/!-------------------------------( )- ! 0339 OR         474     INTERNAL   SEW CYCLE ONE FINISHED
     ! 475   052                             475  ! 0340 OUT          475     INTERNAL   SEW CYCLE
     !
     !INTER
     !NAL
     !-! !--------
     ! 474
     !
     !
     !SEW S COUNT                           SEW S ! 0341 ORG          322     SEW SPEED  SEW SPEED B
341- !PEED  ER                              PEED  ! 0342 AND  NOT     052     COUNTER    PRESET TWO
344  !-! !---!/!-------------------------------( )- ! 0343 OR         474     INTERNAL   SEW CYCLE ONE FINISHED
     ! 322   052                             322  ! 0344 OUT          322     SEW SPEED  SEW SPEED B
     !
     !INTER
     !NAL
     !-! !--------
     ! 474
     !
     !
     !EYE   INTER                           INTER ! 0345 ORG          049     EYE        START SEW EYE
345- !      NAL                              NAL   ! 0346 AND  NOT     477     INTERNAL   STACKER OPEN
347  !-! !---!/!-------------------------------( )- ! 0347 OUT          476     INTERNAL   ONE SHOT ON STACKER TO OPEN
     ! 049   477                             476  !
     !
     !
     !INTER PROX                            INTER ! 0348 ORG          477     INTERNAL   STACKER OPEN
348- !NAL                                    NAL   ! 0349 AND  NOT     026     PROX       FOLDER BLADE DOWN
351  !-! !---!/!-------------------------------( )- ! 0350 OR         476     INTERNAL   ONE SHOT ON STACKER TO OPEN
     ! 477   026                             477  ! 0351 OUT          477     INTERNAL   STACKER OPEN
     !
     !INTER
     !NAL
     !-! !--------
     ! 476
     !
     !
     !INTER TIMER                           INTER ! 0352 ORG          479     INTERNAL   TIME STACKER IS OPEN
352- !NAL                                    NAL   ! 0353 AND  NOT     T022    TIMER      STACKER OPEN TIME
355  !-! !---!/!-+-----------------------------( )- ! 0354 OR         476     INTERNAL   ONE SHOT ON STACKER TO OPEN
     ! 479   T022                            479  ! 0355 OUT          479     INTERNAL   TIME STACKER IS OPEN
     !
     !INTER
     !NAL
     !-! !--------+
     ! 476
     !
     !
     !INTER                                 SOL   ! 0356 ORG          479     INTERNAL   TIME STACKER IS OPEN
356- !NAL                                          ! 0357 OUT          293     SOL        STACKER OPEN / CLOSE
357  !-! !-----------------------------------( )- !
     ! 479                                   293  !
     !
```

```
    !INTER                          +----------! 0358 ORG          479     INTERNAL  TIME STACKER IS OPEN
358- !NAL                           !TMR   T022 ! 0359 OUT          T022  2.0 TIMER     STACKER OPEN TIME
359  !-! !-------------------------!    2.0   ! !
     ! 479                          !TIMER    ! !
                                    +----------!
     !
     !-    EYE   EYE                     -     ! 0360 ORG          512     -
360- !                                         ! 0361 AND          050     EYE       INSIDE GUIDE EYE
364  !-! !---! !---! !-------------------------! !- ! 0362 AND      049     EYE       OUTSIDE GUIDE EYE
     ! 512   050   049 !                  515   ! 0363 OR          475     INTERNAL  SEW CYCLE
                      !                        ! 0364 OUT          515     -
     !INTER           !                        !
     !NAL             !                        !
     !-! !-------------                        !
     ! 475                                     !
     !                                         !
     !                                         !
     !-    EYE   EYE                   MOTOR   ! 0365 ORG          512     -
365- !                                         ! 0366 AND  NOT     050     EYE       INSIDE GUIDE EYE
369  !-! !---!/!---!/!-------------------------( )- ! 0367 AND  NOT  049     EYE       OUTSIDE GUIDE EYE
     ! 512   050   049                   271   ! 0368 OUT          271     MOTOR     GUIDER MOTOR
     !                                         !
     !                                         !
     !INTER COUNT                       SEW S ! 0369 ORG          470     INTERNAL  SEW CYCLE ONE START
369- !NAL   ER                          PEED  ! 0370 OR           323     SEW SPEED SEW SPEED A
372  !-! !-+-!/!-----------------------------( )- ! 0371 AND  NOT  052     COUNTER   PRESET TWO
     ! 470 ! 052                        323   ! 0372 OUT          323     SEW SPEED SEW SPEED A
     !     !                                   !
     !SEW S!                                   !
     !PEED !                                   !
     !-! !-+                                   !
     ! 323                                     !
     !                                         !
     !                                         !
     !SWITC SWITC                       SOL   ! 0373 ORG NOT      010     SWITCH-   PICKERS UP
373- !H-    H-                                 ! 0374 AND          015     SWITCH-   PICKERS DOWN
379  !-!/!---! !-+-----------------------------( )- ! 0375 STR NOT 010     SWITCH-   PICKERS UP
     ! 010   015 !                       287   ! 0376 AND          287     SOL       HOLD DOWN FINGER UP
     !          !                              ! 0377 OR STR
     !SWITC SOL  !                             ! 0378 OUT          287     SOL       HOLD DOWN FINGER UP
     !H-         !                             !
     !-!/!---! !-+                             !
     ! 010   287                               !
     !                                         !
     !                                         !
     !PROX                              INTER ! 0379 ORG          026     PROX      FOLDER BLADE DOWN
379- !                                   NAL   ! 0380 STR          500     INTERNAL  SEW CYCLE BEGIN
383  !-! !-------+-----------------------------( )- ! 0381 AND  NOT 283     SOL       GUIDER DOWN
     ! 026       !                       500   ! 0382 OR STR
     !           !                             ! 0383 OUT          500     INTERNAL  SEW CYCLE BEGIN
     !INTER SOL                                !
     !NAL        !                             !
     !-! !---!/!--                             !
     ! 500   283                               !
     !                                         !

     !INTER -                          ----------  0384 ORG          475     INTERNAL  SEW CYCLE
384- !NAL                              !TMR   T023  0385 AND  NOT   T024     -
385  !-  ---  !-------------------------!    1.0   ! ! 0386 OUT     T023  1.0 -
      475   T024                       !-         !
                                       ----------!
     !
     !-    COUNT                       ----------! 0387 ORG          505     -
387- !      ER                          TMR   T024 ! 0388 AND  NOT  052     COUNTER   PRESET TWO
391  !-  ---  !-------------------------     0.3   ! ! 0389 OR      T023     -
      505   052 !                       !-         ! ! 0390 OUT     T024  0.3 -
     !           !                      ----------! 0391 OUT      505     -
```

BEST AVAILABLE COPY

```
     !-          !                          -
     !           !                          !
     !-! !-----------------------------------( )-  !
     ! T023                                 505  !
     !                                            !
     !                                            !
     !INTER                                MOTOR  ! 0392 ORG          501    INTERNAL  SEW BELT RUN
392- !NAL                                    -   ! 0393 OR           T023    -
394  !-! !-+-----------------------------------( )-  ! 0394 OUT          270    MOTOR -   FEED BELTS TO SEWING HEAD
     ! 501 !                                 270  !
     !    !                                       !
     !-   !                                       !
     !    !                                       !
     !-! !-+                                      !
     ! T023                                       !
     !                                            !
     !                                            !
     !TIMER COUNT                              -  ! 0395 ORG          T020    TIMER     TIME BEFORE SEW FOOT DROP
395- !     ER                                     ! 0396 OR           511     -
393  !-! !---!/!-----------------------------( )-  ! 0397 AND  NOT     052     COUNTER   PRESET TWO
     ! T020! 052                              511  ! 0398 OUT          511     -
     !    !                                       !
     !-   !                                       !
     !    !                                       !
     !-! !-+                                      !
     ! 511                                        !
     !                                            !
     !-    EYE   EYE                           -  ! 0399 ORG          512     -
399- !                                            ! 0400 AND  NOT     051     EYE       INSIDE GUIDE EYE
408  !-! !---!/!---!/!-----------------------------( )-  ! 0401 AND  NOT     048     EYE       OUTSIDE GUIDE EYE
     ! 512   051   048 !                       510  ! 0402 STR          512     -
     !                 !                            ! 0403 AND          051     EYE       INSIDE GUIDE EYE
     !-    EYE   EYE   !                            ! 0404 AND          048     EYE       OUTSIDE GUIDE EYE
     !                 !                            ! 0405 OR STR
     !-! !---! !---! !-!                            ! 0406 STR          475     INTERNAL  SEW CYCLE
     ! 512   051   048 !                            ! 0407 OR STR
     !                 !                            ! 0408 OUT          510     -
     !INTER            !                            !
     !NAL              !                            !
     !-! !-------------+                            !
     ! 475                                          !
     !                                            !
     !                                            !
     !TIMER COUNT                              -  ! 0409 ORG          T020    TIMER     TIME BEFORE SEW FOOT DROP
409- !     ER                                     ! 0410 OR           512     -
412  !-! !--!/!-----------------------------( )-  ! 0411 AND  NOT     051     COUNTER   PRESET ONE
     ! T020! 051                              512  ! 0412 OUT          512     -
     !    !                                       !
     !-   !                                       !
     !    !                                       !
     !-! !-+                                      !
     ! 512                                        !
     !                                            !
     !                                            !
     !SOL   EYE   EYE   SWITC                  -  ! 0413 ORG          284     SOL       PICKERS PICK
413- !                 H-                         ! 0414 OR           285     SOL       NOT USED
421  !-! !-+-!/!---!/!---! !-+-----------------( )-  ! 0415 AND  NOT     020     EYE       PICKER JAM EYE
     ! 284 ! 020   021   010 !                 513  ! 0416 AND  NOT     021     EYE       PICKER JAM EYE
     !    !                 !                      ! 0417 AND          010     SWITCH-   PICKERS UP
     !SOL !                 !                      ! 0418 STR          513     -
     !    !                 !                      ! 0419 AND          035     SWITCH-   CYCLE STOP
     !-! !-+               !                      ! 0420 OR STR
     ! 285                 !                      ! 0421 OUT          513     -
     !                     !                      !
     !-    SWITC           !                      !
     !     H-              !                      !
     !-! !---! !-------------+                     !
```

```
    ! 513   035                                  !
    !                                            !
    !                                            !
    !LIGHT SWITC                          LIGHT ! 0422 ORG            301     LIGHT     NO PART AT FEEDER
422-!      H-                                    ! 0423 AND            035     SWITCH-   CYCLE STOP
428 !-! !---! !-------+-------------------------( )- ! 0424 STR            513     -
    ! 301   035      !                     301  ! 0425 AND  NOT        022     EYE       SECOND PIN FEEDER STOP EYE
    !                 !                          ! 0426 AND            033     PROX-     (X) HOME
    !-     EYE   PROX-!                          ! 0427 OR STR
    !                 !                          ! 0428 OUT            301     LIGHT     NO PART AT FEEDER
    !-! !---!/!---! !-+                          !
    ! 513   022   033                            !
    !                                            !
    !                                            !
    !INTER                                LIGHT ! 0429 ORG            400     INTERNAL  AUTO CYCLE
429-!NAL                                         ! 0430 OUT            304     LIGHT     AUTO CYCLE
430 !-! !-------------------------------------( )- !
    ! 400                                  304  !
    !                                            !
    !                                            !
    !LIGHT SWITC                          LIGHT ! 0431 ORG            302     LIGHT     BAD FEED
431-!      H-                                    ! 0432 AND            035     SWITCH-   CYCLE STOP
435 !-! !---! !-----------------------------( )- ! 0433 OR             029     PROX      Y POSITION EYES EXTENDED
    ! 302   035 !                          302  ! 0434 OR             032     PROX      X EXTENDED
    !           !                                ! 0435 OUT            302     LIGHT     BAD FEED
    !PROX       !                                !
    !           !                                !
    !-! !-------!                                !
    ! 029       !                                !
    !           !                                !
    !PROX       !                                !
    !           !                                !
    !-! !-------+                                !
    ! 032                                        !
    !                                            !
    !                                            !
    !PROX                                 LIGHT ! 0436 ORG NOT        013     PROX      TABLE IN
436-!                                            ! 0437 OUT            303     LIGHT     TABLE NOT IN
437 !-!/!-----------------------------------( )- !
    ! 013                                  303  !
    !                                            !
    !                                            !
    !SEW S COUNT                          SEW S ! 0438 ORG            320     SEW SPEED SEW SPEED D
438-!PEED  ER                                PEED ! 0439 AND  NOT        052     COUNTER   PRESET TWO
441 !-! !---!/!-+-----------------------------( )- ! 0440 OR             470     INTERNAL  SEW CYCLE ONE START
    ! 320   052 !                          320  ! 0441 OUT            320     SEW SPEED SEW SPEED D
    !           !                                !
    !INTER      !                                !
    !NAL        !                                !
    !-! !-------+                                !
    ! 470                                        !
    !                                            !
    !                                            !
    !MOTOR                                MOTOR ! 0442 ORG            271     MOTOR     GUIDER MOTOR
442-!                                            ! 0443 OR             515     -
444 !-! !-+-------------------------------------( )- ! 0444 OUT            281     MOTOR     GUIDER MOTOR
    ! 271 !                                281  !
    !     !                                      !
    !-    !                                      !
    !     !                                      !
    !-! !-+                                      !
    ! 515                                        !
    !                                            !
```

```
    !SOL   TIMER LIGHT LIGHT          +----------+ ! 0445 ORG            285     SOL       NOT USED
445-!                                 !FUN28     ! ! 0446 AND  NOT       T001    TIMER     PICK RELEASE TIME
455 !-! !---!/!-+-!/!---!/!-+-------------!BRANCH   ! ! 0447 STR            015     SWITCH-   PICKERS DOWN
    ! 285   T001! 301   303 !           !          ! ! 0448 AND            406     -         NOT USED
    !                       !           +----------+ ! 0449 OR STR
    !SWITC -    !           !                SOL     ! 0450 AND  NOT        301     LIGHT     NO PART AT FEEDER
    !H-         !           !                        ! 0451 AND  NOT        303     LIGHT     TABLE NOT IN
    !-! !---! !-+           !-------------------( )- ! 0452 FUN28 BRANCH
    ! 015   406             !                 285    ! 0453 OUT            285     SOL       NOT USED
                            !                        ! 0454 FUN29 RETURN
                            !           +----------+ ! 0455 OUT            T026  0.1 -
    !                       !           !FUN29     ! !
                            !-------------!RETURN   ! !
    !                       !           !          ! !
    !                       !           +----------+ !
    !                       !           +----------+ !
    !                       !           !TMR   T026 !
    !                       +-------------!    0.1  ! !
                            !           !-         ! !
    !                       !           +----------+ !
    !                                                !
    !SOL   SWITC                            -        ! 0456 ORG            284     SOL       PICKERS PICK
456-!      H-                                       ! 0457 AND            010     SWITCH-   PICKERS UP
461 !-! !---! !-------------------------------( )- ! 0458 STR            406     -         NOT USED
    ! 284   010 !                            406     ! 0459 AND  NOT       407     -         NOT USED
    !          !                                    ! 0460 OR STR
    !-     -   !                                    ! 0461 OUT            406     -         NOT USED
    !          !                                    !
    !-! !---!/!-+                                    !
    ! 406   407                                     !
    !                                               !
    !                                               !
    !SOL   SWITC                            -        ! 0462 ORG            285     SOL       NOT USED
462-!      H-                                       ! 0463 AND            010     SWITCH-   PICKERS UP
465 !-! !---! !-+-------------------------------( )- ! 0464 OR             044     SWITCH    RETURN TO HOME
    ! 285   010 !                            407     ! 0465 OUT            407     -         NOT USED
    !          !                                    !
    !SWITC     !                                    !
    !H         !                                    !
    !-! !-------+                                    !
    ! 044                                           !
    !                                               !
    !                                               !
    !SOL   -                                SOL     ! 0466 ORG            280     SOL       AIR JET AT PICKERS
466-!                                               ! 0467 AND  NOT       T028    -
469 !-! !---!/!-+-------------------------------( )- ! 0468 OR             T027    -
    ! 280   T028!                            280     ! 0469 OUT            280     SOL       AIR JET AT PICKERS
    !          !                                    !
    !-         !                                    !
    !          !                                    !
    !-! !-------+                                    !
    ! T027                                          !
    !                                               !
    !SOL   SWITC                          +----------+ ! 0470 ORG            280     SOL       AIR JET AT PICKERS
470-!      H-                             !TMR   T028 ! ! 0471 AND            010     SWITCH-   PICKERS UP
472 !-! !---! !-------------------------------!    1.0  ! ! 0472 OUT            T028  1.0 -
    ! 280   010                           !-         ! !
    !                                     +----------+ !
    !                                                  !
    !SOL   SWITC                          +----------+ ! 0473 ORG            282     SOL       PICKERS UP & DOWN
473-!      H-                             !TMR   T027 ! ! 0474 AND            015     SWITCH-   PICKERS DOWN
479 !-! !---! !-------------------------------!    0.6  ! ! 0475 STR            408     INTERNAL  SEALS IN TIMER # 27
    ! 282   015 !                          !-         ! ! 0476 AND  NOT       280     SOL       AIR JET AT PICKERS
    !          !                          +----------+ ! 0477 OR STR
    !INTER SOL !                                INTER  ! 0478 OUT            T027  0.6 -
    !NAL       !                                NAL    ! 0479 OUT            408     INTERNAL  SEALS IN TIMER # 27
```

BEST AVAILABLE COPY

```
    !-! !---!/!-----------------------------------( )- !
    ! 408   290                                   408  !
    !                                                  !
    !                                                  !
    !INTER                                     CONTR ! 0480 ORG          520     INTERNAL   X TO MOVE OUT
480-  NAL                                       OL   ! 0481 OR           521     INTERNAL   X TO MOVE HOME
482 !-! !-+-------------------------------------( )- ! 0482 OUT          344     CONTROL    ENERGIZES STEPPER MOTOR CONTR
    ! 520 !                                     344  !
    !     !                                          !
    !INTER!                                          !
    !NAL  !                                          !
    !-! !-+                                          !
    ! 521                                            !
    !                                                !
    !                                                !
    !INTER                                     MOTOR ! 0483 ORG          521     INTERNAL   X TO MOVE HOME
483-  !NAL                                            ! 0484 OUT          340     MOTOR      X TO ORIENT POSITION
484 !-! !-------------------------------------( )- !
    ! 521                                        340  !
    !                                                !
    !                                                !
    !INTER                                     MOTOR ! 0485 ORG          440     INTERNAL   X MOVE OUT
485-  !NAL                                            ! 0486 OR           441     INTERNAL   X MOVE IN
487 !-! !-+-------------------------------------( )- ! 0487 OUT          342     MOTOR      X TO HOME POSITION
    ! 440 !                                     342  !
    !     !                                          !
    !INTER!                                          !
    !NAL  !                                          !
    !-! !-+                                          !
    ! 441                                            !
    !                                                !
    !                                                !
    !MOTOR                                      -   ! 0488 ORG          295     MOTOR      FOLDER FEED BELTS RUN
488-  !                                               ! 0489 STR NOT      026     PROX       FOLDER BLADE DOWN
492 !-! !-------+-----------------------------( )- ! 0490 AND          522     -
    ! 295       !                                522 ! 0491 OR STR
    !           !                                     ! 0492 OUT          522     -
    !PROX  -    !                                     !
    !           !                                     !
    !-!/!---! !-+                                     !
    ! 026   522                                       !
```

What is claimed is:

1. Article positioning apparatus comprising:

a positioning surface;

means for sensing the location of an article on the positioning surface with reference to an X direction, with reference to a Y direction perpendicular thereto, and with reference to an angular orientation in the plane of the positioning surface about an axis generally perpendicular to the X direction and the Y direction, said sensing means comprising at least one Y sensor and at least two X-theta sensors, the Y sensor including a pair of photoelectric eyes offset from one another in the Y direction, the X-theta sensors each including a pair of photoelectric eyes offset from one another in the X direction;

means for moving the article in the X direction;

means for moving the article in the Y direction;

means for rotating the article generally about the axis; and control means responsive to said sensing means for selectively activating said X moving means, said Y moving means, and said rotating means, said control means operating said X moving means, said Y moving means and said rotating means until the work piece is positioned so that one electric eye of each sensor is blocked by the work piece and the other eye of each sensor is unblocked.

2. Article positioning apparatus as set forth in claim 1 further comprising a manipulator adapted for engagement with the article on the positioning surface and means for supporting said manipulator over the positioning surface, and wherein said X moving means is adapted to move the manipulator in the X direction, wherein the Y moving means is adapted to move the manipulator in the Y direction, and wherein said rotating means is adapted to pivot the manipulator about the axis.

3. Article positioning apparatus as set forth in claim 2 comprising means for moving the manipulator between a first position spaced above the positioning surface and a second position close to the positioning surface for engaging the article on the positioning surface.

4. Article positioning apparatus as set forth in claim 3 wherein the manipulator comprises an arm having a pad of high friction material at the lower end thereof for engaging the article.

5. Article positioning apparatus as set forth in claim 2 wherein said rotating means comprises a theta motor controlled by said control means to rotate the manipulator arm about the axis.

6. Article positioning apparatus as set forth in claim 5 wherein said means for moving the article in the Y direction comprises a Y motor controlled by said control means for moving the manipulator in the Y-direction.

7. Article positioning apparatus as set forth in claim 6 wherein said means for moving the article in the X direction comprises an X motor controlled by said control means for moving the manipulator in the X direction.

8. Article positioning apparatus as set forth in claim 7 wherein said control means is adapted to simultaneously operate said theta, X and Y motors in response to signals received from said sensing means.

9. Article positioning apparatus as set forth in claim 7 wherein said theta motor is mounted on a first frame member, said Y motor is mounted on a second frame member, said first frame member being attached to the second frame member for relative movement with respect to the second frame member in the Y direction, the second frame member being supported generally adjacent the positioning surface for motion in the X direction.

10. Article positioning apparatus as set forth in claim 1 wherein said control means is adapted to simultaneously operate said means for moving in the X direction, said means for moving in the Y direction and said rotating means in response to signals received from said sensing means.

11. Article positioning apparatus comprising:

a positioning surface;

means for sensing the location of an article on the positioning surface with reference to an X direction, with reference to a Y direction perpendicular thereto, and with reference to an angular orientation in the plane of the positioning surface about an axis generally perpendicular to the X direction and the Y direction, said sensing means comprising two Y sensors for sensing the location of the article on the positioning surface with reference to the Y direction, said Y sensors being spaced from each other in the Y direction, and wherein the apparatus further comprises means mounting the Y sensors for movement in the Y direction toward and away from each other;

means for moving the article in the X direction;

means for moving the article in the Y direction;

means for rotating the article generally about the axis; and control means responsive to said sensing means for selectively activating said X moving means, said Y moving means, and said rotating means.

12. Article positioning apparatus as set forth in claim 11 wherein said control means controls said Y sensor mounting means for moving said Y sensors toward each other, said control means being operable upon detection of an edge of the article by a first of the Y sensors to activate said Y moving means for moving the article toward a second of the Y sensors.

13. A method of positioning an article on a positioning surface comprising the steps of:

providing at least one Y direction sensor including a pair of photoelectric eyes offset from one another in the Y direction;

providing at least two X-theta direction sensors, each including a pair of photoelectric eyes offset from one another in the X direction;

sensing the location of the article on the positioning surface in reference to the X direction;

sensing the location of the article on the positioning surface in reference to the Y direction perpendicular to the X direction;

sensing an angular position theta of the article on the positioning surface about an axis generally perpendicular to the X direction and the Y direction;

moving the article in the X direction in response to X direction sensing;

moving the article in the Y direction in response to Y direction sensing; and rotating the article generally about the axis in response to angular position sensing;

said steps of moving the article in the X direction, moving the article in the Y direction and rotating the article about the axis are carried out until the article is positioned so that one photoelectric eye of each sensor is blocked by the article and the other eye of each sensor is unblocked.

14. A method as set forth in claim 13 wherein the steps of moving the article in the X direction, moving the article in the Y direction and rotating the article generally about the axis are carried out simultaneously.

15. A method as set forth in claim 13 wherein said step of moving the article in the Y direction comprises centering the article with respect to a predetermined center line.

* * * * *